US007967290B2

(12) United States Patent
Yasui et al.

(10) Patent No.: US 7,967,290 B2
(45) Date of Patent: Jun. 28, 2011

(54) IMAGE FORMING APPARATUS AND OPERATION METHOD OF IMAGE FORMING APPARATUS

(75) Inventors: Kazumasa Yasui, Tokyo (JP); Yousuke Ushiyama, Shizuoka (JP); Tetsuo Shiba, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 337 days.

(21) Appl. No.: 12/209,001

(22) Filed: Sep. 11, 2008

(65) Prior Publication Data

US 2009/0072472 A1 Mar. 19, 2009

Related U.S. Application Data

(60) Provisional application No. 60/972,737, filed on Sep. 14, 2007.

(51) Int. Cl.
*B65H 39/10* (2006.01)

(52) U.S. Cl. ..... 271/301; 271/302; 271/225

(58) Field of Classification Search ..... 271/301, 271/302, 225

See application file for complete search history.

(56) References Cited

U.S. PATENT DOCUMENTS

| | | | | |
|---|---|---|---|---|
| 6,112,047 | A * | 8/2000 | Kato et al. | 399/381 |
| 6,263,185 | B1 * | 7/2001 | Kato et al. | 399/381 |
| 6,571,074 | B2 * | 5/2003 | Suzuki et al. | 399/124 |
| 7,416,181 | B2 * | 8/2008 | Murakami et al. | 271/162 |
| 7,784,786 | B2 * | 8/2010 | Tashiro et al. | 271/264 |
| 2004/0251609 | A1 * | 12/2004 | Taniguchi | 271/225 |
| 2008/0211171 | A1 * | 9/2008 | Kusumi | 271/225 |
| 2009/0121416 | A1 * | 5/2009 | Tashiro et al. | 271/225 |
| 2009/0166966 | A1 * | 7/2009 | Nishikata et al. | 271/272 |
| 2009/0267283 | A1 * | 10/2009 | Mizuguchi | 271/3.14 |

FOREIGN PATENT DOCUMENTS

JP 2007-219420 8/2007

* cited by examiner

*Primary Examiner* — Stefanos Karmis
*Assistant Examiner* — Howard Sanders
(74) *Attorney, Agent, or Firm* — Patterson & Sheridan, LLP

(57) ABSTRACT

In an image transferring apparatus of the invention, a relay unit, which is provided in a main body frame and includes a conveyance switching mechanism to eject a sheet on which an image is fixed by a fixing section to a sheet ejection section or to switch back the sheet in the middle of ejection, can be pulled out, and a automatic duplex unit to guide the switched back sheet to an image forming section is mounted to the main body frame to be capable of being detached. An intermediate unit to guide the sheet switched back by the relay unit, together with the fixing section, is fixed and placed in the main body frame. The intermediate unit is provided with a guide member to be capable of being opened and closed between a guide position for the switched back sheet and an open position opposite to the guide position. The guide member always receives a spring force toward the open position, and when the automatic duplex unit is mounted to the main body frame, the guide member is moved to the guide position by contact with a pressing body of the automatic duplex unit side, and when the automatic duplex unit is detached from the main body frame, the guide member is opened to the open position by the spring force.

19 Claims, 9 Drawing Sheets

IMAGE FORMING APPARATUS AND OPERATION METHOD OF IMAGE FORMING APPARATUS

CROSS-REFERENCE TO RELATED APPLICATION

This application is based upon and claims the benefit of priority from U.S. provisional Application Ser. No. 60/972,737, filed on Sep. 14, 2007, the entire contents of which are incorporated herein by reference.

BACKGROUND OF THE INVENTION

1. Field of the Invention

The present invention relates to an image forming apparatus in which visibility of a sheet path in a main body frame is improved for jam countermeasures or the like, and an operation method of the image forming apparatus.

2. Description of the Related Art

In an image forming apparatus such as a laser printer or a digital copier, as disclosed in JP-A-2007-219420, a so-called automatic duplex unit (ADU) is provided to reverse a sheet one side of which is printed and to again convey it to an image forming section, so that both sides of the sheet can be printed.

In general, in this kind of image forming apparatus, a specified image is transferred in an image forming section to a sheet fed one by one from a sheet feeding section, and the image transferred to the sheet is fixed by a fixing section. The sheet on which the image is fixed is ejected to a specified sheet ejection section, or is not ejected but is switched back and is sent to an automatic duplex unit. The sheet is again sent from the automatic duplex unit to the image forming section, and a specified image is printed also on the opposite side.

In the image forming apparatus as stated above, a relay unit is required which includes a conveyance switching mechanism for guiding the sheet after fixing from the fixing section to the specified sheet ejection section or for switching back it. Besides, an intermediate unit is also required which guides the sheet switched back from the relay unit to the automatic duplex unit. As stated above, there are plural sheet paths after the fixing, and these are suitably switched and used, and accordingly, a so-called jam can occur in which the sheet is jammed along the path in the middle of conveyance.

Here, since each of the relay unit and the automatic duplex unit can be constructed in one unit, it is easy that they can be constructed to be capable of being pulled out to the outside from the main body frame or can be constructed to be capable of being detached from the main body frame. Thus, even if a jam occurs in these sheet paths, a jam processing can be easily performed in the outside of the main body frame, not the narrow portion in the main body frame, without receiving spatial restriction.

On the other hand, a fixing section includes a high temperature fixing roller and is hard to handle, and is, together with power source lines for a heat source and switches for those, mounted in the main body frame. Besides, as described above, the intermediate unit is for guiding the sheet switched back by the relay unit to the automatic duplex unit, and is disposed near the fixing section because of the arrangement of the respective parts. Thus, it is difficult that the intermediate unit is construct to be capable of being pulled out to the outside of the main body frame, and is, together with the fixing section, fixed and placed in the main body frame also in view of the improvement of safety.

In the image forming apparatus having the structure as stated above, when a jam occurs, for the purpose of facilitating jam handling and maintenance, the relay unit is pulled out to the outside of the main body frame, and the automatic duplex unit is detached from the main body frame. A checker uses the space generated in the main body frame by the pulling out and the detaching of these to check a sheet path of the intermediate unit remaining in the main body frame, and performs the jam processing as the need arises.

However, since a guide member to guide the sheet switched back to the automatic duplex unit is provided along the sheet path in the intermediate unit, the visibility of the sheet path is bad, and there is a problem that even if a sheet remains in the intermediate unit by the occurrence of a jam, this is difficult to find, and the workability of the jam processing is bad.

SUMMARY OF THE INVENTION

It is an object of the present invention to provide an image forming apparatus in which the visibility of a sheet path of an intermediate unit remaining in a main body frame is improved, and a jam processing is facilitated, and an operation method of the image forming apparatus.

According to an aspect of the invention, an image forming apparatus includes a main body frame; a sheet feeding section that is provided in the main body frame and feeds a sheet one by one; an image forming section that is provided in the main body frame and transfers a specified image to the sheet fed from the sheet feeding section; a fixing section that is provided in the main body frame and fixes the image transferred to the sheet by the image forming section; a relay unit that is provided in the main body frame to be capable of being pulled out, and includes a conveyance switching mechanism to eject the sheet on which the image is fixed by the fixing section to a specified sheet ejection section or to switch back it without ejecting; an intermediate unit that is, together with the fixing section, fixed and placed in the main body frame, and guides the sheet switched back by the relay unit toward a specified direction; an automatic duplex unit that is mounted to the main body frame to be capable of being detached therefrom, and guides the switched back sheet guided by the intermediate unit to the image forming section; a guide member that is provided in the intermediate unit, is constructed to be capable of being opened and closed between a specified guide position for the switched back sheet and an open position opposite to the guide position, and always receives a spring force toward the open position; and an opening and closing mechanism that is provided in the intermediate unit, moves, when the automatic duplex unit is mounted to the main body frame, the guide member to the guide position by contact with a pressing body of the automatic duplex unit side, and opens, when the automatic duplex unit is detached from the main body frame, the guide member to the open position by the spring force.

Besides, according to another aspect of the invention, an operation method of an image forming apparatus includes the steps of: pulling out, from a main body frame, a relay unit which can switch back a sheet by a conveyance switching mechanism after transferring a specified image by an image forming section to the sheet fed one by one from a sheet feeding section provided in the main body frame and fixing the transferred image to the sheet by a fixing section; detaching, from the main body frame, an automatic duplex unit which guides the switched back sheet in a specified direction toward the image forming section, the sheet being switched back by the relay unit and being taken in by an intermediate unit fixed and placed, together with the fixing section, in the main body frame; moving a guide member, which is provided in the intermediate unit, is constructed to be capable of being opened and closed between a specified guide position for the switched back sheet and an open position opposite to the guide position, and always receives a spring force toward the open position, to the guide position by contact of an opening and closing mechanism provided in the intermediate unit with a pressing body of the automatic duplex unit side when the automatic duplex unit is mounted to the main body frame; and opening the guide member to the open position by the spring force when the automatic duplex unit is detached from the main body frame.

DETAILED DESCRIPTION OF THE INVENTION

Hereinafter, embodiments of the invention will be described in detail with reference to the accompanying drawings.

Figure 1:
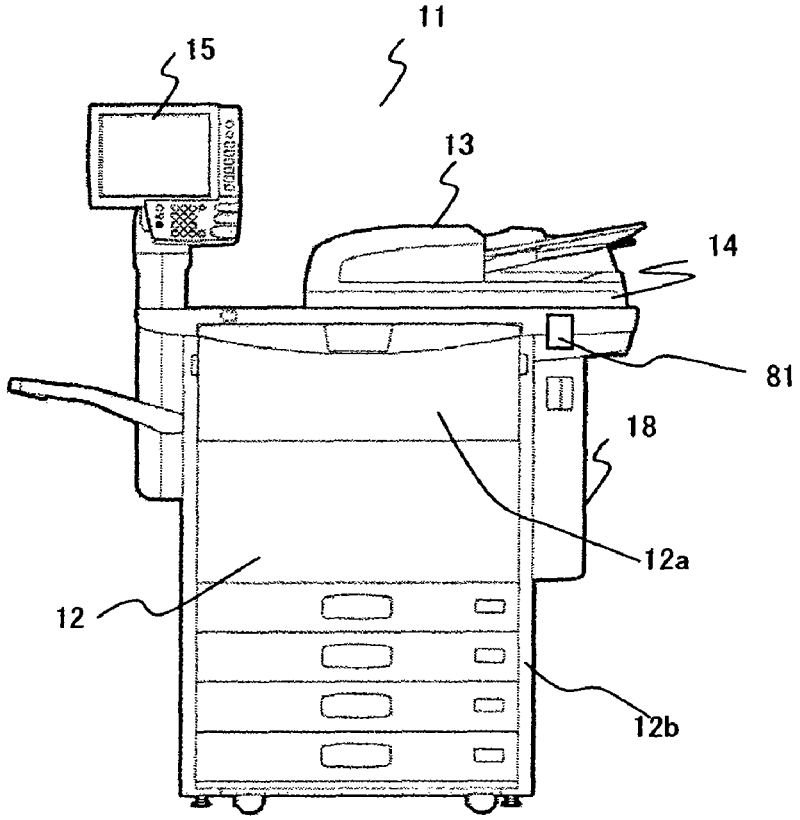
FIG. 1 is a front view showing an outer appearance shape of an image forming apparatus of a first embodiment of the invention.

FIG. 1 is a front view showing an outer appearance shape of a color copier 11 as an image forming apparatus of an embodiment of the invention. In FIG. 1, an auto document feeder 13 and a scanner section 14 are provided at an upper part of a main body frame 12 forming a case shape. The auto document feeder 13 feeds an original document as a copy object to the scanner section 14 one by one. The scanner section 14 reads the original document sent from the auto feeder 13 and generates image data. Besides, an operation panel 15 is provided to stand upward at the side of the main body frame 12.

Figure 2:
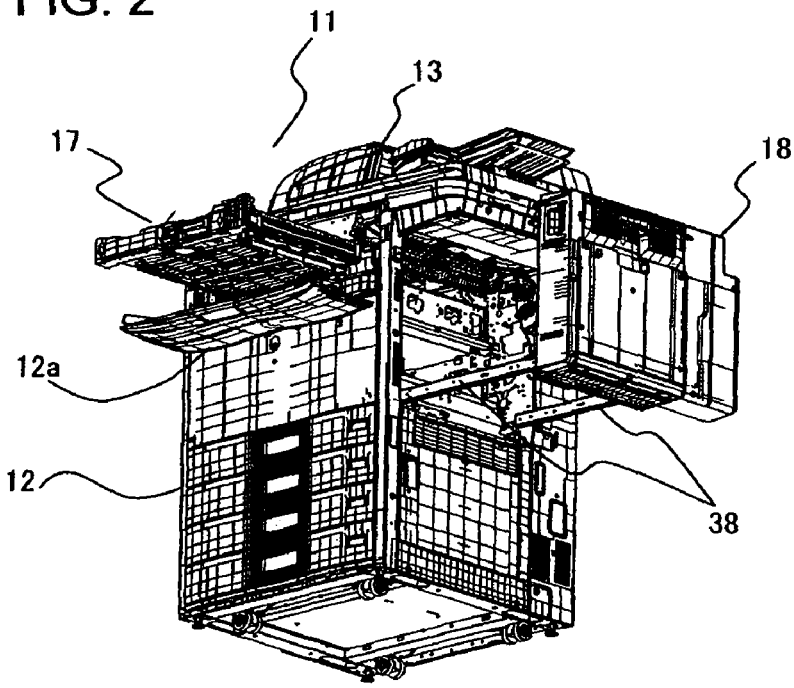
FIG. 2 is a perspective view of the image transferring apparatus of the first embodiment of the invention viewed from obliquely below.
Figure 3:
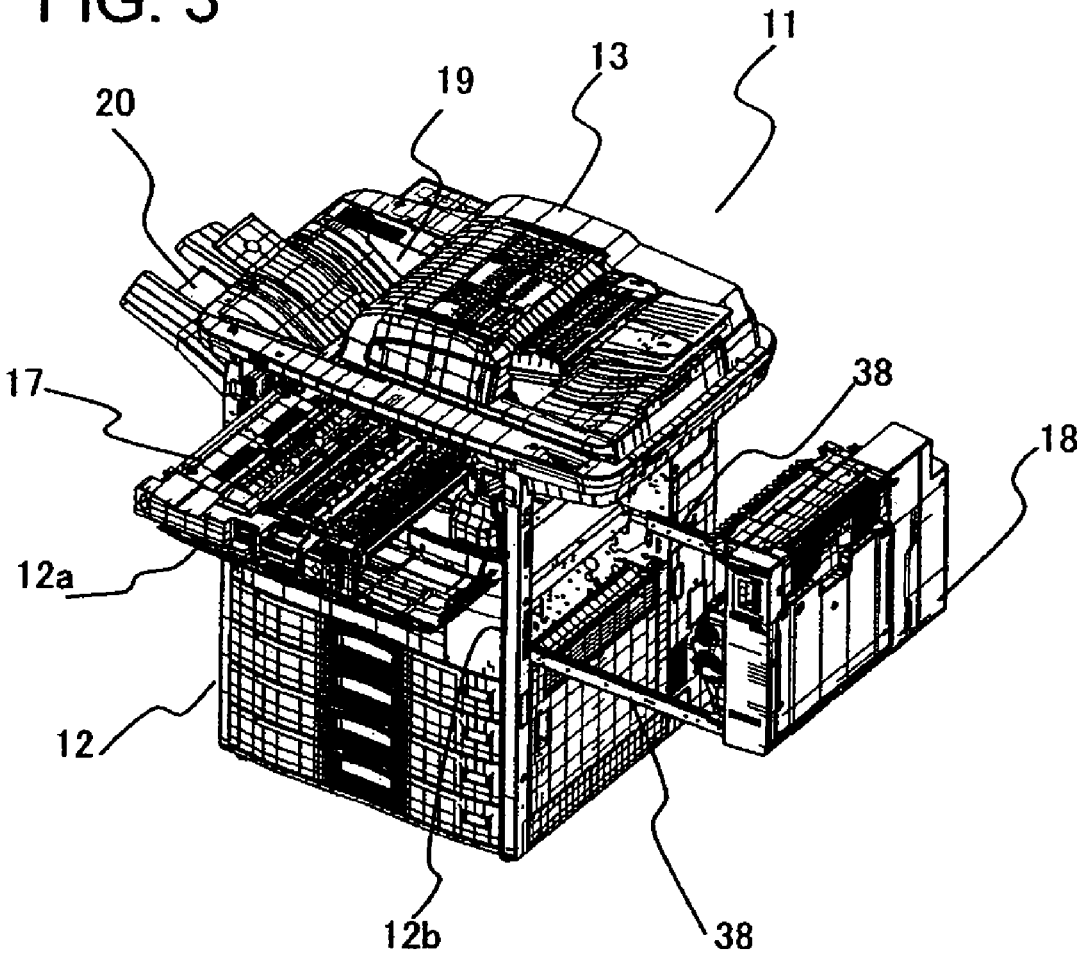
FIG. 3 is a perspective view of the image transferring apparatus of the first embodiment of the invention viewed from obliquely above.

FIG. 2 is a perspective view of the color copier 11 viewed from obliquely below, and FIG. 3 is a perspective view of the color copier 11 viewed from obliquely above. These figures show a state in which an after-described relay unit 17 provided in the main body frame 12 is pulled out to the outside, and an automatic duplex unit 18 attached to the right side, in the drawing, of the main body frame 12 is laterally moved in parallel and is detached from the main body frame 12. Incidentally, the illustration of the operation panel 15 is omitted.

Besides, as shown in FIG. 3, a first sheet ejection section 19 is formed at an upper surface (portion close to the left in the drawing) of the main body frame 12, and a second sheet ejection section 20 is provided at the left side, in the drawing, of the main body frame as shown in FIG. 1 and FIG. 3.

Next, a structure in the main body frame 12 will be described with reference to FIG. 4. The scanner section 14 shown in FIG. 1 to FIG. 3 is provided at the upper part of the main body frame 12. Incidentally, the illustration of the auto document feeder 13 is omitted. A sheet feeding section 22 to feed a sheet one by one is provided at the lower part in the main body frame 12, and an image forming section 23 to transfer a specified image to the sheet fed from the sheet feeding section 22 is provided above it. A fixing section 24 to fix the image transferred to the sheet by the image forming section 23 is provided at the downstream side (upper part in the drawing) of the image forming section 23, and an intermediate unit 25 is provided at the further upper part thereof.

The relay unit 17 is disposed at the downstream side (left side in the drawing) of the fixing section 24 and between the first sheet ejection section 19 and the second sheet ejection section 20, and is constructed to be capable of being pulled out to the front side of the main body frame 12 as shown in FIG. 2 and FIG. 3. Besides, the automatic duplex unit 18 is disposed on the opposite side across the intermediate unit 25 from the relay unit 17, that is, on the right side, in the drawing, of the main body frame 12, and is constructed to be capable of being detached from the main body frame 12 as described before. The intermediate unit 25 has a function to guide the sheet switched back from the relay unit 17 to the automatic duplex unit 18, and is disposed at the upper part of the fixing section 24 between the relay unit 17 and the automatic duplex unit 18. Thus, in view of the safety at the time of checking work, the intermediate unit 17, together with the fixing section 24, is fixed and placed in the main body frame 12.

In the image forming apparatus having the structure as stated above, when a jam occurs, for the purpose of facilitating jam processing and maintenance, the relay unit 17 is pulled out to the outside of the main body frame 12 and the jam processing is performed. Further, the automatic duplex unit 18 is detached from the main body frame 12 and the jam processing is performed in the external wide space.

However, since the intermediate unit 25, together with the fixing section 24, remains in the main body frame 12, the checking work of jam existence and the jam processing work must be performed in the dark and narrow space in the main body frame 12, and the workability is bad. Especially, since a guide member to guide the switched back sheet to the automatic duplex unit 18 is provided, the visibility from the outside is bad, and the checking work and the processing work at the time of occurrence of the jam are difficult.

Then, in the invention, a new structure is added in order to facilitate the checking work and the processing work at the time of jam occurrence. Hereinafter, a specific structure for that, together with the detailed structures of the respective sections, will be described.

The sheet feeding section 22 takes out a sheet one by one from one of plural sheet feeding cassettes 27 stacked and disposed at the lower part in the main body frame 12 and feeds the sheet to the image forming section 23 disposed above that. The sheet feeding section 22 includes a pickup roller 27*a* to take out the sheet from the sheet feeding cassette 27, a separating roller 27*b*, a conveyance roller 27*c*, and a register roller pair 28, and these constitute a sheet feed mechanism. A manual feed mechanism 31 is provided near the sheet feeding section 22, and a manual feed pickup roller 31*b* and a manual feed separating roller 31*c* are provided between a manual feed tray 31*a* and the register roller pair 28.

The image forming section 23 forms a color image by a four-tandem system. The image forming section 23 includes four sets of image forming stations 41Y, 41M, 41C and 41K of yellow (Y), magenta (M), cyan (C) and black (K) disposed in parallel along the lower side of an intermediate transfer belt 40.

The respective image forming stations 41Y, 41M, 41C and 41K include photoconductive drums 42Y, 42M, 42C and 42K. Charging chargers 43Y, 43M, 43C and 43K, developing devices 44Y, 44M, 44C and 44K, and photoconductive cleaning devices 46Y, 46M, 46C and 46K are disposed around the photoconductive drums 42Y, 42M, 42C and 42K along a rotation direction of an arrow m direction. Exposure beams from a laser exposure device 47 is irradiated to the photoconductive drums 42Y, 42M, 42C and 42K between the charging chargers 43Y, 43M, 43C and 43K and the developing devices 44Y, 44M, 44C and 44K, and electrostatic latent images are formed on the photoconductive drums 42Y, 42M, 42C and 42K. That is, the laser exposure device 47 forms the electrostatic latent images on the photoconductive drums 42Y, 42M, 42C and 42K based on image data read from an original document by the scan section 14.

The developing devices 44Y, 44M, 44C and 44K respectively include two-component developers made of toners of yellow (Y), magenta (M), cyan (C) and black (K) and carriers, and supply the toners to the electrostatic latent images on the photoconductive drums 42Y, 42M, 42C and 42K.

The intermediate transfer belt 40 is stretched by a backup roller 51, a driven roller 50 and first to third tension rollers 52 to 54. The intermediate transfer belt 40 is opposite to and in contact with the photoconductive drums 42Y, 42M, 42C and 42K. Primary transfer rollers 48Y, 48M, 48C and 48K to primarily transfer toner images on the photoconductive drums 42Y, 42M, 42C and 42K to the intermediate transfer belt 40 are provided at positions where the intermediate transfer belt 40 is opposite to the photoconductive drums 42Y, 42M, 42C and 42K. The primary transfer rollers 48Y, 48M, 48C and 48K are respectively conductive rollers, and primary transfer bias voltages are applied to the respective primary transfer sections.

A secondary transfer roller 57 is disposed at a secondary transfer section as a transfer position where the intermediate transfer belt 40 is supported by the backup roller 51. In the secondary transfer section, the backup roller 51 is a conductive roller, and a specified secondary transfer bias is applied. When the sheet of the print object passes through between the intermediate transfer belt 40 and the secondary transfer roller 57, the toner image on the intermediate transfer belt 40 is secondarily transferred onto the sheet. After the secondary transfer is ended, the intermediate transfer belt 40 is cleaned by a belt cleaner 40*a*.

Here, the register roller 28 sends the sheet to between the intermediate transfer belt 40 and the secondary transfer roller 57 at the timing synchronous with the transfer operation of the image to the sheet by the intermediate transfer belt 40 and the secondary transfer roller 57.

The fixing section 24 includes a heat roller 24*a* for heat fixation and a pressure roller 24*b* coming in contact with the heat roller 24*a*. The image transferred to the sheet is fixed by the heat roller 24*a* and the pressure roller 24*b*. As stated above, the fixing section 24 includes the high temperature heat roller for fixation, and is, together with not-shown power source lines for heat source and switches for them, fixed and placed in the main body frame 12. Besides, a guide member 26 to guide the sheet subjected to the fixing process to the subsequent relay unit is provided above the heat roller 24*a* and the pressure roller 24*b* in the fixing section 24. The guide member 26 is pivotably supported so that one end edge (right end edge in the drawing) can be rotated, and is rotated clockwise in the drawing around a pivoted point, so that a space between the heat roller 24*a* and the pressure roller 24*b* can be visually recognized from above in the drawing, and it is possible to confirm whether a sheet is jammed therebetween.

The relay unit 17 has a function to eject the sheet on which the image is fixed by the fixing section 24 to one of the sheet ejection sections 19 and 20, or to switch back the sheet and to send it to the intermediate unit 25 side without ejecting it to the sheet ejection section 19 or 20. That is, a pair of sheet eject drive rollers 61 are provided at an inlet portion (right end part in the drawing), and plural pairs of conveyance rollers 62 are disposed on straight lines between the inlet portion and the first sheet ejection section 19 and between the inlet portion and the second sheet ejection section 20.

Besides, a first guide member 63 and a second guide member 64 are provided as a sheet conveyance path switching mechanism in the relay unit 17.

The first guide member 63 is disposed just after the pair of sheet eject drive rollers 61, and the left end edge in the drawing is rotatably supported. The structure is made such that by this rotation, it can be stopped in a state where its right end edge is inclined obliquely upward in the drawing, and a state where the right end edge is inclined obliquely downward although not shown. The second guide member 64 is disposed on the sheet path to the first sheet ejection section 19, and its left end edge in the drawing is rotatably supported. The structure is made such that by this rotation, it can be stopped in a state where the right end edge is inclined obliquely upward in the drawing, and a state where it is inclined obliquely downward although not shown.

In the relay unit 17, when the sheet after fixing is ejected to the second sheet ejection section 20, the first guide member 63 is inclined obliquely right upward as shown in the drawing. In this state, the sheet sent from the pair of sheet eject drive rollers 61 to the left in the drawing is guided by this first guide member 63 to the sheet path side (obliquely left downward in the drawing) to the second sheet ejection section 20, is sent to the left in the drawing by the plural pairs of conveyance rollers 62 provided along the sheet path, and is ejected to the second sheet ejection section 20.

Besides, when the sheet after fixing is ejected to the sheet ejection section 19, the first guide member 63 and the second guide member 64 are respectively inclined obliquely right downward. In this case, the sheet sent to the left in the drawing from the pair of sheet eject drive rollers 61 is guided to the sheet path side (obliquely upward in the drawing) to the first sheet ejection section 19, and is sent left upward in the drawing by the plural pairs of conveyance rollers 62 provided along the sheet path. At this time, since the second guide member 64 is also inclined obliquely right downward in the drawing, the sheet passes the upper surface of the second guide member 64 and is ejected to the first sheet ejection section 19.

When the sheet after fixing is switched back, the first guide member 63 is inclined obliquely right downward in the drawing, and the second guide member 64 is inclined obliquely right upward as shown in the drawing. In this case, the sheet sent from the pair of sheet eject drive rollers 61 to the left in the drawing is guided to the sheet path side (obliquely left upward in the drawing) to the first sheet ejection section 19 by the first guide member 63, and is sent left upward in the drawing by the plural pairs of conveyance rollers 62 provided along the sheet path. However, since the second guide member 64 is inclined obliquely right upward in the drawing, the leading end of the sheet during conveyance is guided by the lower surface of the second guide member 64, and enters a hold space formed under the first sheet ejection section 19. Accordingly, the sheet is not ejected to the first sheet ejection section 19.

In this state, when the trailing end of the sheet during conveyance passes the upper surface of the first guide member 63, the rotation direction of the conveyance roller 62 is reversed, and the first guide member 63 is inclined obliquely right upward as shown in the drawing. By this operation, the sheet moved to the left in the drawing is inverted and moved to the right in the drawing. That is, the so-called switch back operation is performed. At this time, since the first guide member 63 is inclined obliquely right upward in the drawing, the leading end of the switched back sheet is guided by the upper surface of the first guide member 63, and is sent into the intermediate unit 25.

The intermediate unit 25 includes a pair of feed rollers 65 which take in the switched back sheet and send it to the right in the drawing, and a guide member 66 to guide the sheet to the automatic duplex unit 18 positioned at the right in the drawing.

The automatic duplex unit 18 includes plural pairs of conveyance rollers 67 to convey the switched back sheet guided by the intermediate unit 25 downward in the drawing. The sheet conveyed downward in the automatic duplex unit 18 is sent to the upstream side of the register roller 28, and is again sent to the image forming section 23 by the register roller 28. A specified image is transferred to the surface opposite to the previous one.

Figure 4:
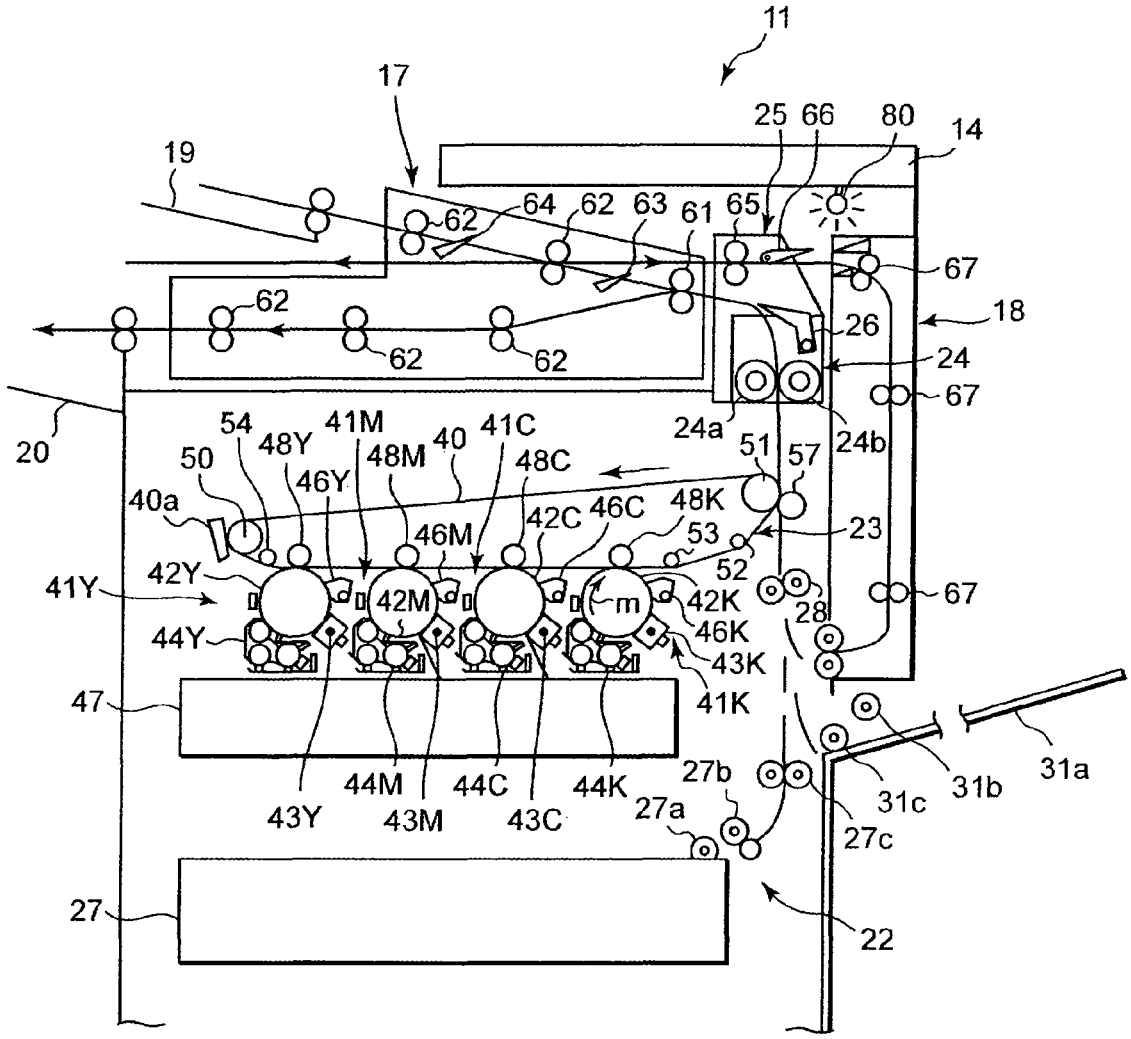
FIG. 4 is a front view showing the outline of an inner structure of the image transferring apparatus of the first embodiment of the invention.

Here, the relay unit 17 is constructed to be capable of being pulled out in the direction orthogonal to the sheet surface of FIG. 4 by a pulling mechanism constructed at both sides although not shown. Accordingly, in the checking work or processing work at the time of jam occurrence, as shown in FIG. 2 and FIG. 3, an upper front cover 12*a* of the main body frame 12 is opened, and the relay unit 17 can be pulled out to the outside of the main body frame 12.

Besides, as shown in FIG. 2 and FIG. 3, the automatic duplex unit 18 is constructed to be capable of being horizontally moved from the side of the main body frame 12 to the outside by a pair of guide arms 38 provided at both ends of the lower side sections. Accordingly, in the checking work and the processing work at the time of the jam occurrence, the automatic duplex unit 18 is moved in parallel to the right in the drawing, and can be detached from the side of the main body frame 12.

On the other hand, as described before, the intermediate unit 25 intervenes between the relay unit 17 and the automatic duplex unit 18, and as shown in FIG. 2 and FIG. 3, even after the relay unit 17 and the automatic duplex unit 18 are moved to the outside of the main body frame 12, the intermediate unit 25, together with the fixing section 24, remains in the main body frame 12. Accordingly, in the checking work or the processing work at the time of the jam occurrence, the operator moves the relay unit 17 and the automatic duplex unit 18 to the outside of the main body frame 12, and must perform visual confirmation from the outside by using the space generated by these movements.

However, the upper part of the intermediate unit 25 is covered with the scan unit 14, and the guide member 66 is provided along the sheet path. Thus, in this structure, the visibility of the sheet path portion where a jam occurs is very bad, and the jam processing is difficult.

Then, the guide member 66 provided in the intermediate unit 25 is constructed to be rotatable around the pivoted point of the left end part in the drawing, and is constructed to be capable of being opened and closed between a specified guide position (almost horizontal state in the drawing) for the switched back sheet and an open position (state where it is inclined obliquely right upward in the drawing) opposite to the guide position. Then, the structure is made such that the opening and closing operation is automatically performed based on whether or not the automatic duplex unit 18 is mounted to the main body frame 12. That is, when the automatic duplex unit 18 is mounted to the main body frame 12 as shown in FIG. 4, the guide member 66 is rotated to the guide position (almost the horizontal position in the drawing), and when the automatic duplex unit 18 is detached from the main body frame 12 as shown in FIG. 2 and FIG. 3, the guide member 66 is opened to the open position (state where it is inclined obliquely right upward in the drawing).

As stated above, as shown in FIG. 2 and FIG. 3, when the automatic duplex unit 18 is detached from the main body frame 12, the guide member 66 automatically performs the opening operation. Accordingly, the visibility of the sheet path portion is greatly improved, and the workability of the checking work and the jam processing work to the intermediate unit 25 at the time of the jam occurrence is improved.

Figure 5:
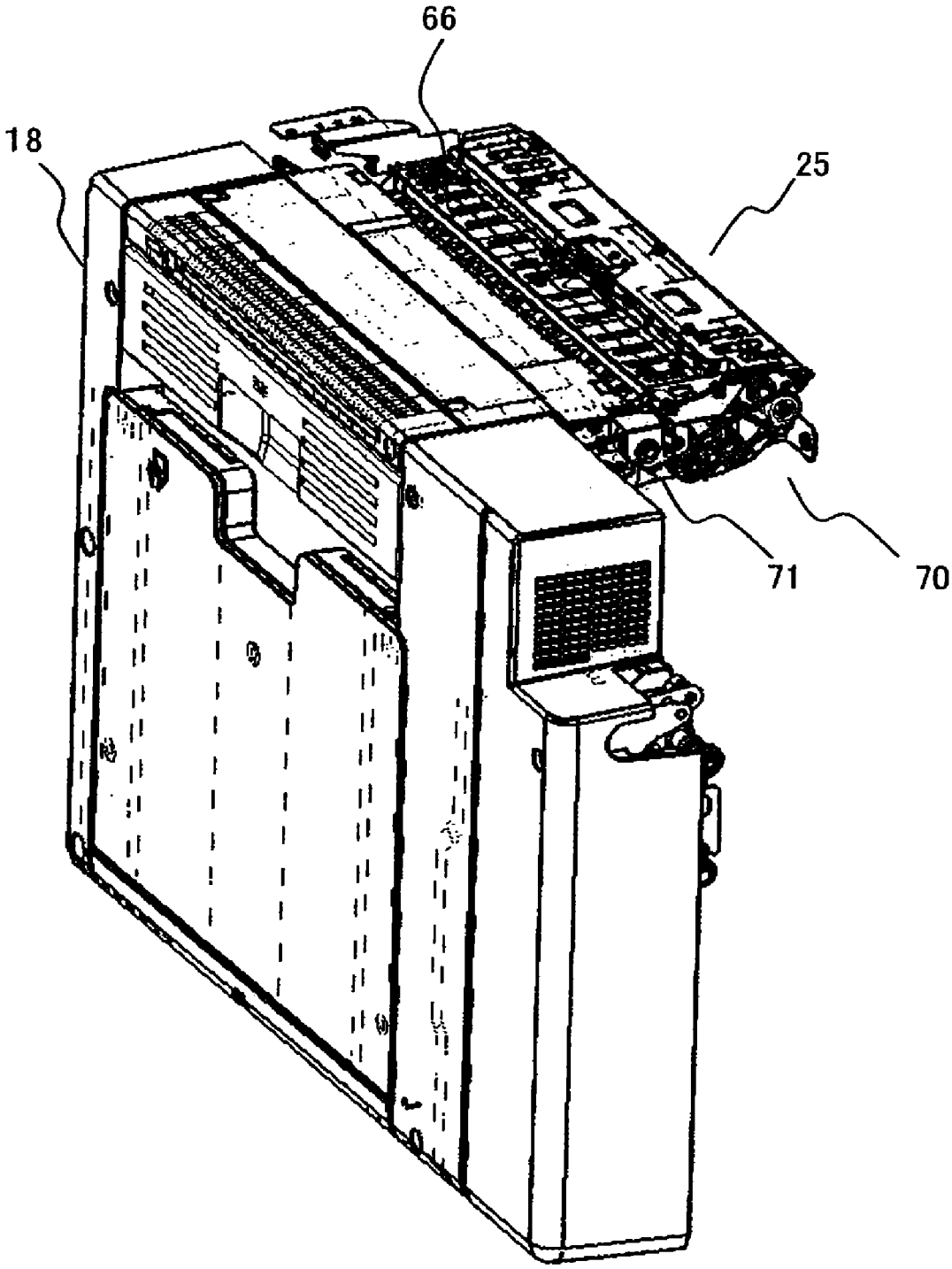
FIG. 5 is a perspective view showing a state of combination of an intermediate unit and an automatic duplex unit in the image transferring apparatus of the first embodiment of the invention.
Figure 6:
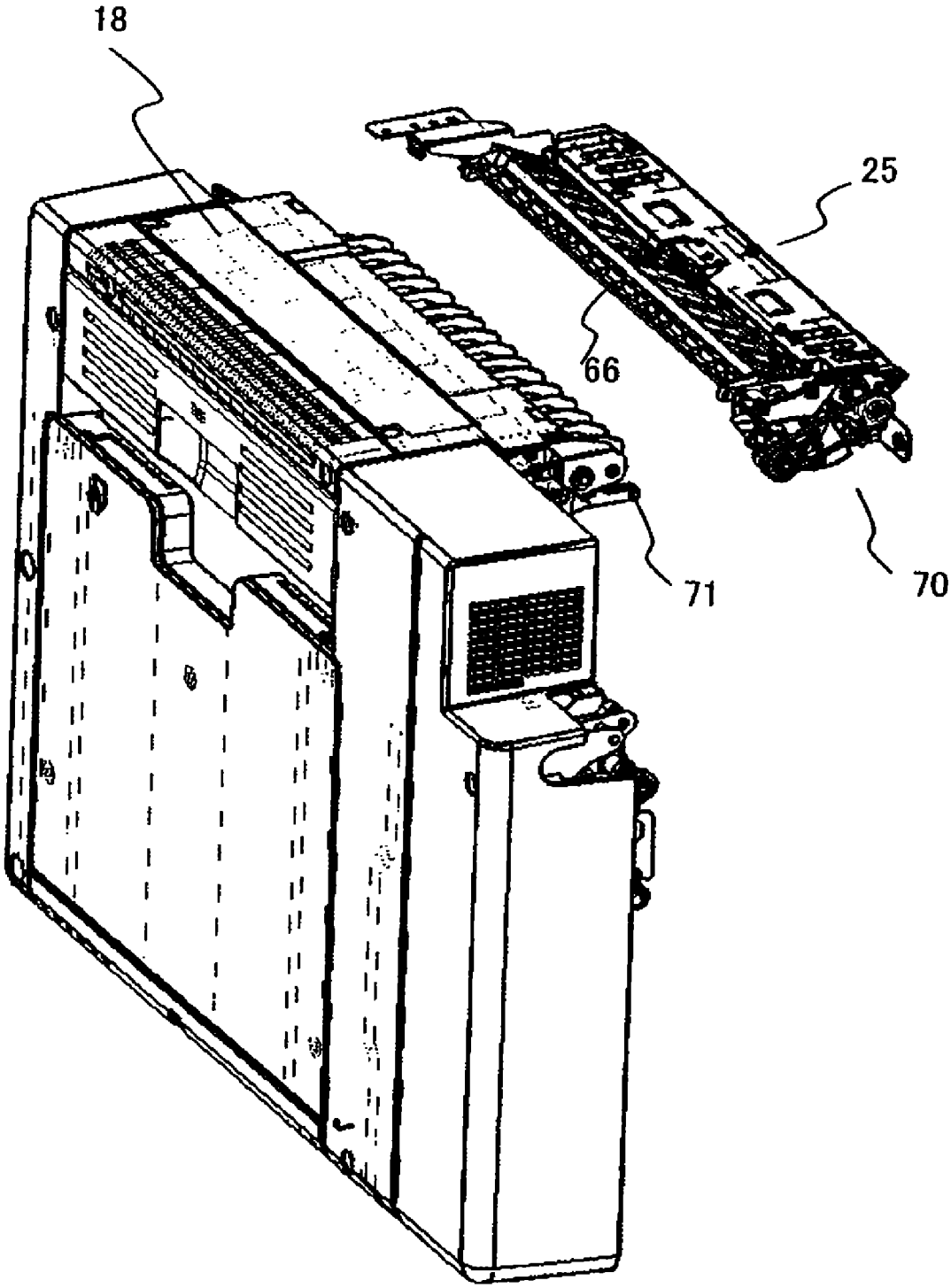
FIG. 6 is a perspective view showing a state of separation of the intermediate unit and the automatic duplex unit in the image transferring apparatus of the first embodiment of the invention.

Next, a mechanism to open and close the guide member 66 will be described in detail. FIG. 5 and FIG. 6 show a relation between the intermediate unit 25 and the automatic duplex unit 18. Incidentally, FIG. 5 shows a state where the automatic duplex unit 18 is mounted to the not-shown main body frame 12, and the guide member 66 is at the guide position (almost horizontal state in the drawing) where the switched back sheet is guided to the automatic duplex unit 18. On the other hand, FIG. 6 shows a state where the automatic duplex unit 18 is moved outward from the not-shown main body frame 12, and is detached from the main body frame 12. In this state, the guide member 66 is opened at the open position (state where it is inclined obliquely upward in the drawing).

That is, an opening and closing mechanism 70 of the guide member 66 is provided on the side of the intermediate unit 25 at the front side in FIG. 5 and FIG. 6. When the automatic duplex unit 18 is mounted to the main body frame 12 (not shown) as shown in FIG. 5, the opening and closing mechanism 70 closes the guide member 66 to the guide position by the contact with a pressing body 71 of the automatic duplex unit 18 side. Besides, when the automatic duplex unit 18 is detached from the main body frame 12 as shown in FIG. 6, the guide member 66 is opened to the open position by a spring force.

Figure 7:
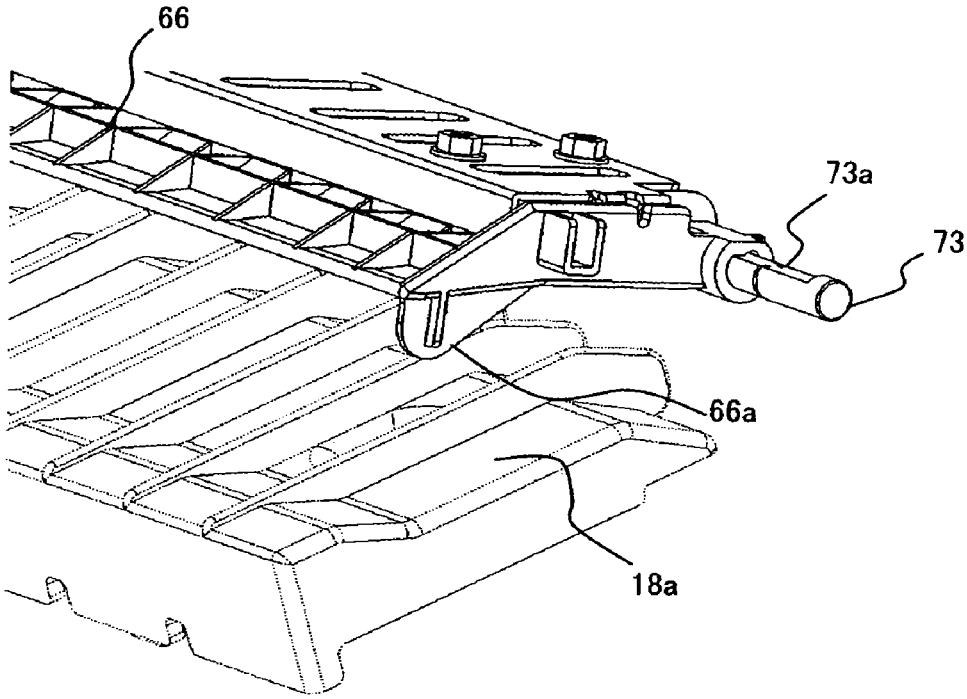
FIG. 7 is a perspective view for explaining an open position of a guide member in the image transferring apparatus of the first embodiment of the invention.
Figure 8:
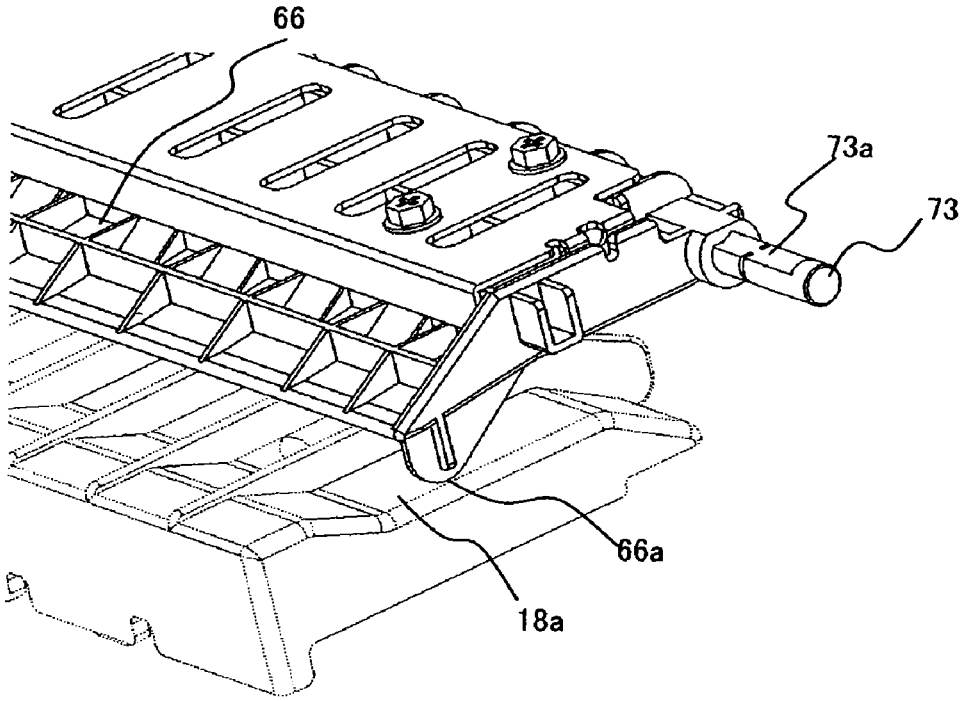
FIG. 8 is a perspective view for explaining a guide position of the guide member in the image transferring apparatus of the first embodiment of the invention.
Figure 9:
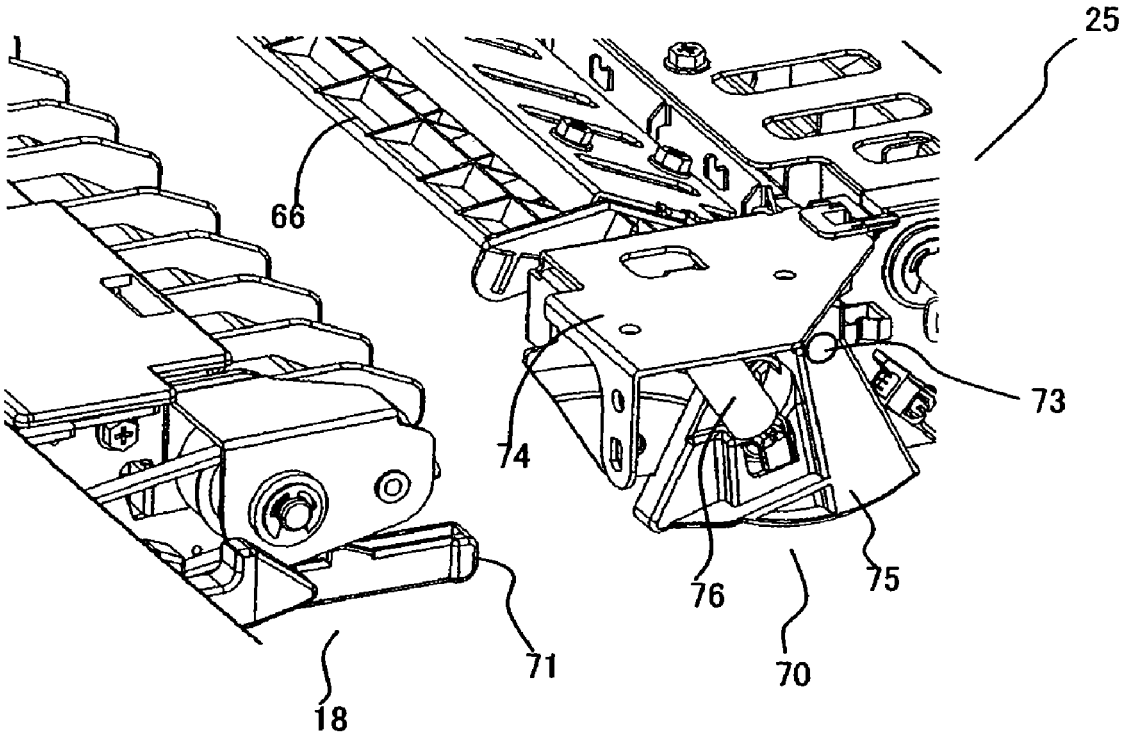
FIG. 9 is a perspective view showing a relation between an opening and closing mechanism and a pressing body of the automatic duplex unit side in the image transferring apparatus of the first embodiment of the invention.

As shown in FIG. 7 and FIG. 8, the whole shape of the guide member 66 is a wing shape, a pivoted shaft 73 is attached to one end side section (right rear end side in the drawing) thereof, and as shown in FIG. 9, the guide member 66 is rotatably held by a support frame 74 provided at the intermediate unit 25 side. The front end edge part of the guide member 66 is opened and closed between the open position shown in FIG. 7 and the guide position shown in FIG. 8 by the rotation around the pivoted shaft 73.

Figure 10:
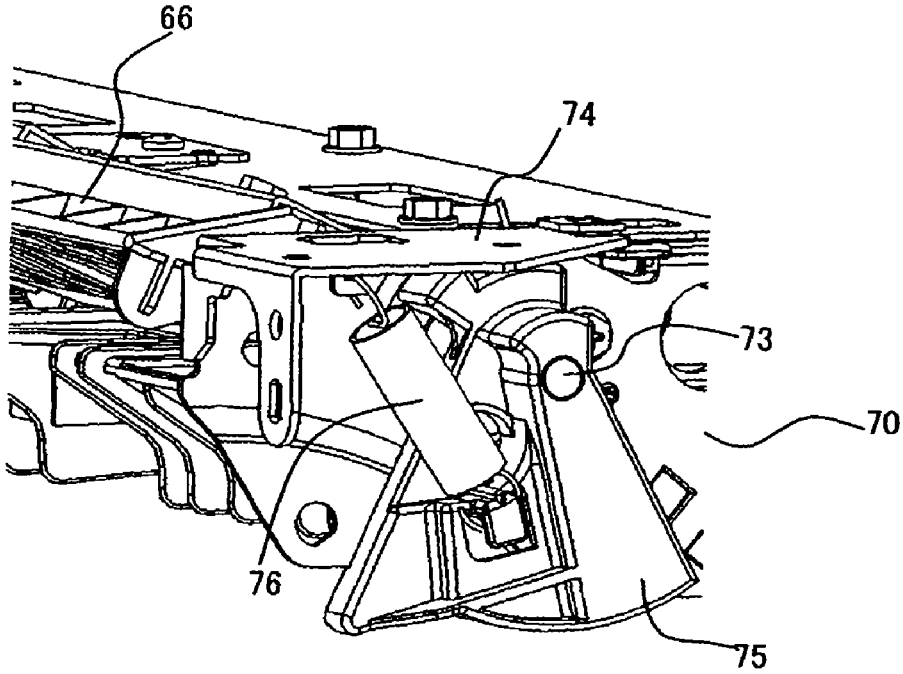
FIG. 10 is a perspective view showing the opening and closing mechanism in the image transferring apparatus of the first embodiment of the invention in a state before pressing by the pressing body of the automatic duplex unit side.
Figure 11:
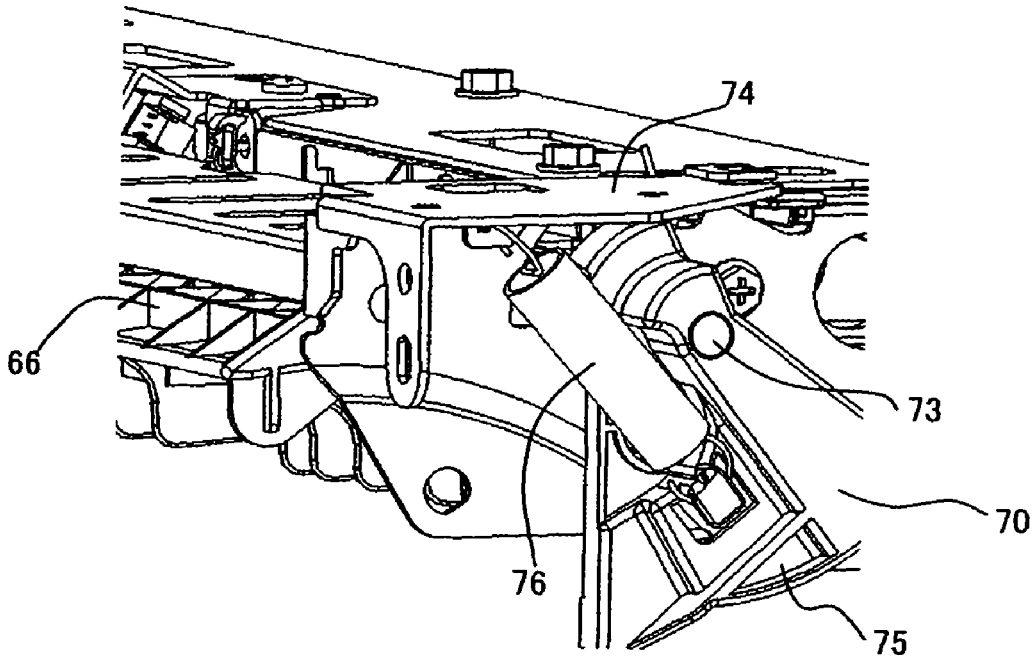
FIG. 11 is a perspective view showing the opening and closing mechanism in the image transferring apparatus of the first embodiment of the invention in a state after pressing by the pressing body of the automatic duplex unit side.

The opening and closing mechanism 70 includes the pivoted shaft 73 and is constructed around the support frame 74. The pivoted shaft 73 includes a plane section 73*a* at a part of its outer periphery, and is attached to the guide member 66 side so that the rotation force can be transmitted by the plane section 73*a*. Besides, as shown in FIG. 9 to FIG. 11, it is integrally coupled to a link member 75 which rotates around the pivoted shaft 73. That is, a rotation supporting point part of the link member 75 is coupled to the one end side section of the guide member 66 through the pivoted shaft 73 so that the rotation force can be transmitted. Besides, as shown in FIG. 9, the free end side of the link member 75 is disposed to be capable of coming in contact with and to be opposite to the pressing body 71 of the automatic duplex unit 18 side. Further, as shown in FIG. 10 and FIG. 11, a spring 76 is provided between the link member 75 and the support frame 74. The spring 76 always applies a clockwise, in the drawing, rotation force to the pivoted shaft 73 through the link member 75. The rotation force functions as an acting force to cause the guide member 66 to perform the opening operation to the open position.

Here, FIG. 9 and FIG. 10 shows a state where the link member 75 is not in contact with the pressing body 71 of the automatic duplex unit 18 side, and the guide member 66 is in the open state by the acting force of the spring 76. On the other hand, in FIG. 11, although not shown, the link member 75 is in contact with the pressing body 71 of the automatic duplex unit 18 side, and is rotated counterclockwise in the drawing against the tensile force of the spring 76, and the guide member 66 performs the closing operation to the guide position.

In this case, the guide member 66 is constructed not to rotate to exceed the specified guide position. For example, as shown in FIG. 7 and FIG. 8, a stopper section 66*a* is formed at the side lower part of the guide member 66, and this is brought into contact with a member 18*a* of the automatic duplex unit 18 side, so that the guide member 66 does not rotate to exceed the specified guide position.

On the other hand, since the opening and closing mechanism 70 causes the guide member 66 to perform the closing operation to the guide position by mounting of the automatic duplex unit 18 to the main body frame 12, according to the way of pressing the automatic duplex unit 18, the operation amount to the guide member 66 by the contact with the pressing body 71 of the automatic duplex unit 18 side is generated to exceed the operation stroke to the specified guide position. However, since the guide member 66 is constructed not to rotate to exceed the specified guide position as described above, when the link member 75 and the guide member 66 are coupled rigidly, there is a possibility that the coupling portion is damaged. Then, a transmission force interrupt section is provided at the coupling portion between the link member 75 and the guide member 66, so that when the link member 75 rotates to exceed the specified rotation angle, the rotation force exceeding the intended rotation angle is not transmitted to the guide member 66. That is, the transmission force interrupt section is a mechanism to prevent the operation force exceeding the operation stroke from being transmitted to the guide member 66 when the operation amount (press amount) by the pressing body 71 exceeds the operation stroke of the guide member 66 to the specified guide position.

Figure 12:
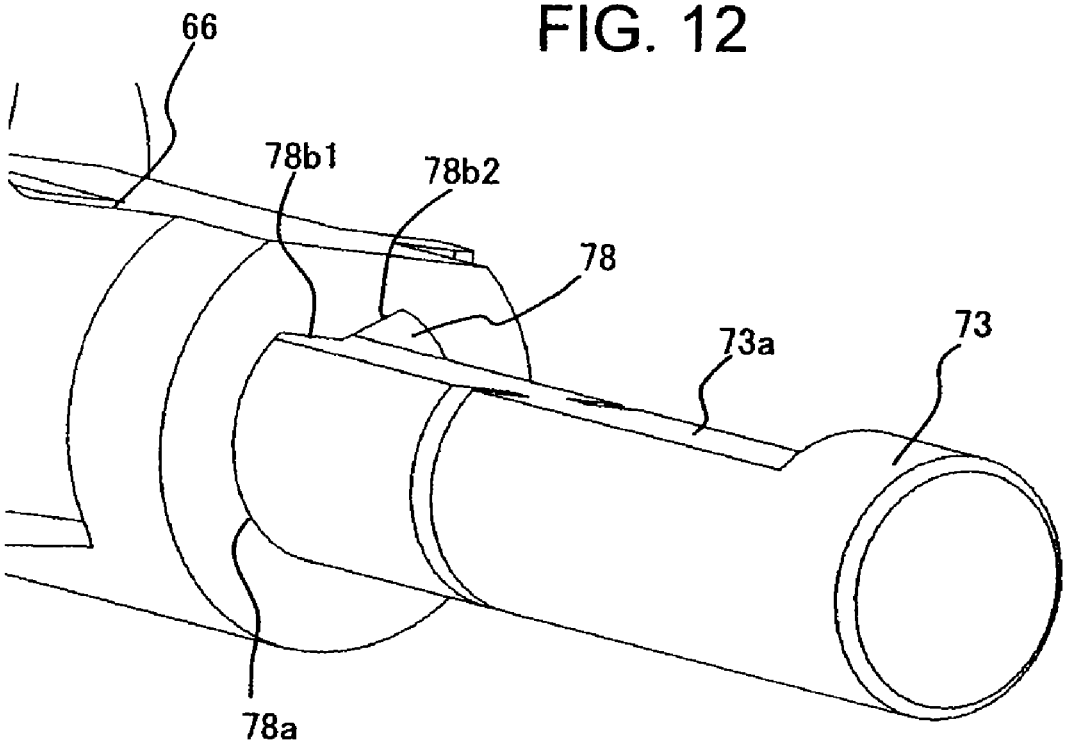
FIG. 12 is a perspective view showing a transmission state of a transmission force interrupt section in the image transferring apparatus of the first embodiment of the invention.
Figure 13:
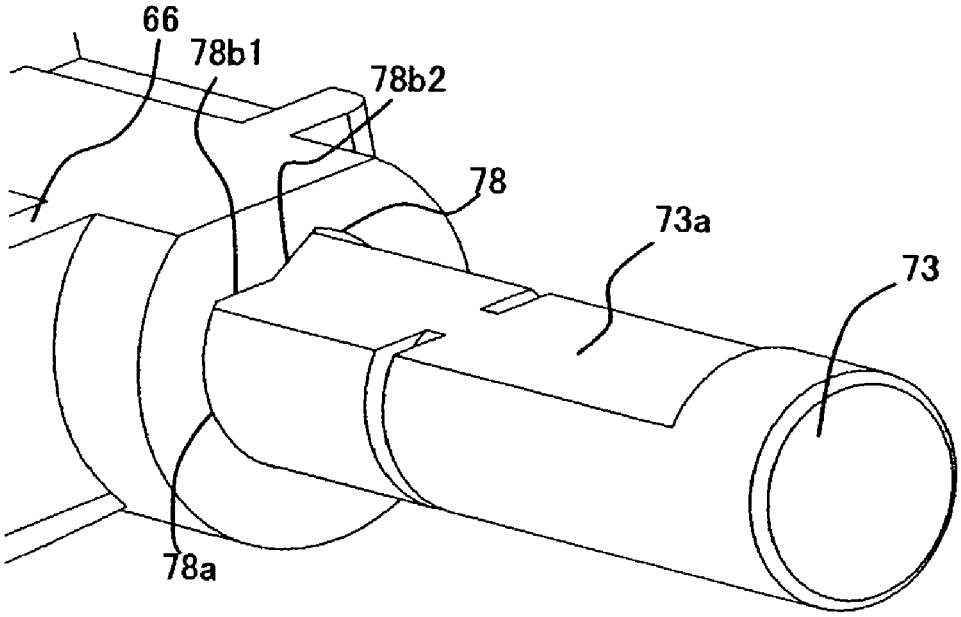
FIG. 13 is a perspective view showing a transmission interrupt state of the transmission force interrupt section in the image transferring apparatus of the first embodiment of the invention.

As shown in FIG. 12 and FIG. 13, the transmission force interrupt section is constructed of the plane section 73*a* of the pivoted shaft 73 and a cross-section shape of a coupling hole 78 of the guide member 66 side to which the pivoted shaft 73 is coupled. The coupling hole 78 includes a circumferential section 78*a* similar to an outer peripheral shape of the pivoted shaft 73 and a plane section 78*b* coming in contact with the plane section 73*a* of the pivoted shaft 73, and the plane section 78*b* includes two planes 78*b*1 and 78*b*2 formed at an angle of 180° or more.

The pivoted shaft 73 always receives the clockwise, in the drawing, rotation force, by the acting force of the spring 76 applied to the integrally coupled link member 75, and as shown in FIG. 12, the plane section 73*a* is connected to the one surface 78*b*1 of the coupling hole 78, and the rotation force toward the open position is applied to the guide member 66. In this state, when the link member 75 is rotated counterclockwise in the drawing by the contact with the pressing body 71, the pivoted shaft 73 integral with it is also rotated in the same direction. In accordance with the counterclockwise rotation of the pivoted shaft 73 in the drawing, the guide member 66 is also rotated counterclockwise in the drawing toward the specified guide position while the surface 78*b*1 of the coupling hole 78 follows the plane section 73*a* of the pivoted shaft 73. When the guide member 66 reaches the specified guide position, the rotation of the guide member 66 is stopped by the stopper section 66*a*.

However, when the press amount by the pressing body 71 is excessive, also after this, the pivoted shaft 73 continues to rotate counterclockwise in the drawing. In this case, since the plane section of the coupling hole 78 in contact with the plane section 73*a* of the pivoted shaft 73 includes the two surfaces 78*b*1 and 78*b*2 of 180° or more, until the plane section 73*a* of the pivoted shaft 73 comes in contact with the other surface 78*b*2 after it is separated from the one surface 78*b*1, the rotation of the pivoted shaft 73 is allowed as shown in FIG. 13. During this, since the rotation force of the pivoted shaft 73 is not transmitted to the guide member 66 side, the excessive force is not applied to the guide member 66 side, and the damage of the relevant portion can be prevented.

In the embodiment, the mechanism to detach the automatic duplex unit 18 from the main body frame 12 is constructed such that it is moved in parallel to the outside of the main body frame 12 by the guide arm 38 provided between itself and the main body side, however, the invention is not limited to the structure as stated above. For example, although not shown, a structure may be made such that the lower part of the automatic duplex unit 18 is rotatably attached to the main body frame by a hinge mechanism, and the upper part of the automatic duplex unit 18 can be attached to and detached from the main body frame 12 by this rotation.

In the invention, further, as shown in FIG. 4, a light emitting element 80 to irradiate the sheet path may be attached to the vicinity of the sheet path in the intermediate unit 17 in the main body frame 12. This light emitting element 80 is constructed to emit light when at least one of the pulling out the relay unit 17 from the main body frame 12 and the document of the automatic duplex unit 18 from the main body frame 12 is detected.

In this case, it is preferable that the irradiation direction of the light emitting element 80 is set to the same direction as the visual recognition direction to the sheet path from the outside of the main body frame 12. For example, when the automatic duplex unit 18 is detached from the main body frame 12 and the sheet path portion where the guide member 66 is opened is visually recognized from the outside of the main body frame 12 by using the open space, the irradiation direction of the light emitting element 80 is set to the same direction as the visual recognition direction, that is, the direction to the sheet path. When setting is made in this way, the worker is not dazzled and the sheet path is irradiated, and accordingly, the checking work or the processing work to the jam is facilitated.

The attachment position of the light emitting element 80 is not limited to the position of FIG. 4, and for example, plural light emitting elements are disposed in the vertical direction at the upper inside of a column 12*b* at the front right of the main body frame 12 shown in FIG. 2 and FIG. 3, and the inside of the main body frame 12 may be irradiated.

Besides, a window to enable a peripheral portion of a sheet path in the intermediate unit to be visually recognized from the outside may be provided in a portion of the main body frame 12 covering the intermediate unit 25 from the outside. In general, the intermediate unit 25, together with the fixing section 24, is attached to the inside of the column 12*b* constituting the main body frame 12. Accordingly, for example, as shown in FIG. 1, when a window 81 is formed in the vicinity of the upper part of the column 12*b*, since the sheet path portion of the intermediate unit 25 can be seen from this window 81, the occurrence of a jam can be easily visually recognized. In this case, when the plural light emitting elements mounted to the upper inside of the column 12*b* are made to emit light, and the sheet path portion is irradiated, the sheet path portion can be more clearly visually confirmed.

What is claimed is:

1. An image forming apparatus comprising:

a main body frame;

a sheet feeding section that is provided in the main body frame and feeds a sheet one by one;

an image forming section that is provided in the main body frame and transfers a specified image to the sheet fed from the sheet feeding section;

a fixing section that is provided in the main body frame and fixes the image transferred to the sheet by the image forming section;

a relay unit that is provided in the main body frame to be capable of being pulled out, and includes a conveyance switching mechanism to eject the sheet on which the image is fixed by the fixing section to a specified sheet ejection section or to switch back the sheet without ejecting;

an intermediate unit that is, together with the fixing section, fixed and placed in the main body frame, and guides the sheet switched back by the relay unit toward a specified direction;

an automatic duplex unit that is mounted to the main body frame to be capable of being detached therefrom, and guides the switched back sheet guided by the intermediate unit to the image forming section, wherein the automatic duplex unit is supported to be capable of performing parallel movement toward outside of the main body frame by a guide arm provided between the automatic duplex unit and the main body frame, and the automatic duplex unit can be attached to and detached from the main body frame by the parallel movement;

a guide member that is provided in the intermediate unit, is constructed to be capable of being opened and closed between a specified guide position at which the switched back sheet is guided to the automatic duplex unit and an open position opposite to the guide position, and receives a spring force toward the open position; and an opening and closing mechanism that is provided in the intermediate unit that moves the guide member to the guide position by contact with a pressing body of an automatic duplex unit side when the automatic duplex unit is mounted to the main body frame, and opens the guide member to the open position by the spring force when the automatic duplex unit is detached from the main body frame.

2. The image forming apparatus of claim 1, wherein the relay unit can be pulled out to a front side of the main body frame, and the automatic duplex unit can be detached to a lateral side of the main body frame.

3. The image forming apparatus of claim 1, wherein the guide member is constructed not to rotate to exceed a specified guide position, and the opening and closing mechanism includes a transmission force interrupt section to prevent, when an operation amount to the guide member by the contact with the pressing body of the automatic duplex unit side exceeds an operation stroke to the specified guide position by mounting of the automatic duplex unit to the main body frame, the operation force exceeding the operation stroke from being transmitted to the guide member.

4. The image forming apparatus of claim 1, wherein a whole shape of the guide member is a wind shape, one end side section thereof is rotatably held, and a front end side section is opened and closed by rotation thereof between the guide position and the open position other than that, the opening and closing mechanism includes a link member whose pivoted point section is coupled to the one end side section of the guide member to be capable of transmitting a rotation force, whose free end side can contact with the pressing body of the automatic duplex unit side, and to which a spring to apply an acting force toward the open position to the guide member is attached, and a coupling section of the link member to the guide member is provided with a transmission force interrupt section to prevent rotation exceeding an intended rotation angle from being transmitted to the guide member when the link member rotates to exceed the intended rotation angle.

5. The image forming apparatus of claim 4, wherein the pivoted point section of the link member is coupled to an integrally rotating pivoted shaft, and a plane section is formed on an outer periphery of the pivoted shaft, the one end side section of the guide member is provided with a coupling hole in which the pivoted shaft is fitted, a contact surface of the coupling hole to the plane section formed on the pivoted shaft has two planes formed at an angle of 180° or more, and the transmission force interrupt section is constructed of a combination of the pivoted shaft and the coupling hole.

6. The image forming apparatus of claim 1, wherein a light emitting element to irradiate a sheet path is attached to a vicinity of the sheet path in the intermediate unit in the main body frame, and the light emitting element is made to emit light when at least one of pulling out the relay unit from the main body frame and detachment of the automatic duplex unit from the main body frame is detected.

7. The image forming apparatus of claim 6, wherein an irradiation direction of the light emitting element is set to a same direction as a visual recognition direction to the sheet path from outside of the main body frame.

8. The image forming apparatus of claim 1, wherein a window to enable a sheet path portion in the intermediate unit to be seen from outside is provided in a portion of the main body frame covering the intermediate unit from the outside.

9. An operation method of an image forming apparatus, comprising the steps of:

pulling out, from a main body frame, a relay unit which can switch back a sheet by a conveyance switching mechanism after transferring a specified image by an image forming section to the sheet fed one by one from a sheet feeding section provided in the main body frame and fixing the transferred image to the sheet by a fixing section;

detaching, from the main body frame, an automatic duplex unit which guides the switched back sheet in a specified direction toward the image forming section, the sheet being switched back by the relay unit and being taken in by an intermediate unit fixed and placed, together with the fixing section, in the main body frame;

moving a guide member, which is provided in the intermediate unit, is constructed to be capable of being opened and closed between a specified guide position for the switched back sheet and an open position opposite to the guide position, and always receives a spring force toward the open position, to the guide position by contact of an opening and closing mechanism provided in the intermediate unit with a pressing body of the automatic duplex unit side when the automatic duplex unit is mounted to the main body frame; and opening the guide member to the open position by the spring force when the automatic duplex unit is detached from the main body frame.

10. The operation method of the image forming apparatus of claim 9, wherein the relay unit is pulled out to a front side of the main body frame, and the automatic duplex unit is detached to a lateral side of the main body frame.

11. The operation method of the image forming apparatus of claim 9, wherein the automatic duplex unit performs parallel movement toward outside of the main body frame by a guide arm provided between itself and the main body frame, and the automatic duplex unit is attached to and detached from the main body frame by the parallel movement.

12. The operation method of the image forming apparatus of claim 9, wherein a lower part of the automatic duplex unit is rotated to the main body frame by a hinge mechanism at an attachment and detachment operation to the main body frame, and an upper part of the automatic duplex unit is attached to and detached from the main body frame by rotation thereof.

13. The operation method of the image forming apparatus of claim 9, wherein the guide member is not rotated to exceed a specified guide position, and the opening and closing mechanism prevents, when an operation amount to the guide member by contact with the pressing body of the automatic duplex unit side exceeds an operation stroke to the specified guide position by mounting of the automatic duplex unit to the main body frame, the operation force exceeding the operation stroke from being transmitted to the guide member by a transmission force interrupt section.

14. The operation method of the image forming apparatus of claim 9, wherein a whole shape of the guide member is a wind shape, one end side section thereof is rotatably held, and a front end side section is opened and closed by rotation thereof between the guide position and the open position other than that, the opening and closing mechanism includes a link member whose pivoted point section is coupled to the one end side section of the guide member to be capable of transmitting a rotation force, its free end side can contact with the pressing body of the automatic duplex unit side, and a spring applies an acting force toward the open position to the guide member, and a transmission force interrupt section formed in a coupling section of the link member to the guide member prevents rotation exceeding an intended rotation angle from being transmitted to the guide member when the link member rotates to exceed the intended rotation angle.

15. The operation method of the image forming apparatus of claim 14, wherein the pivoted point section of the link member is coupled to an integrally rotating pivoted shaft, and a plane section is formed on an outer periphery of the pivoted shaft, the one end side section of the guide member is provided with a coupling hole in which the pivoted shaft is fitted, a contact surface of the coupling hole to the plane section formed on the pivoted shaft has two planes formed at an angle of 180° or more, and the transmission force is interrupted by a combination of the plane section formed on the pivoted shaft and the two planes of the coupling hole having the angle of 180° or more and coming in contact with the plane section.

16. The operation method of the image forming apparatus of claim 9, wherein a light emitting element to irradiate a sheet path is attached to a vicinity of the sheet path in the intermediate unit in the main body frame, and the light emitting element is made to emit light when at least one of pulling out the relay unit from the main body frame and detachment of the automatic duplex unit from the main body frame is detected.

17. The operation method of the image forming apparatus of claim 16, wherein an irradiation direction of the light emitting element is set to a same direction as a visual recognition direction to the sheet path from outside of the main body frame.

18. The operation method of the image forming apparatus of claim 9, wherein a sheet path portion in the intermediate unit is visually recognized from outside through a window provided in a portion of the main body frame covering the intermediate unit.

19. An image forming apparatus comprising:

a main body frame;

a sheet feeding section that is provided in the main body frame and feeds a sheet one by one;

an image forming section that is provided in the main body frame and transfers a specified image to the sheet fed from the sheet feeding section;

a fixing section that is provided in the main body frame and fixes the image transferred to the sheet by the image forming section;

a relay unit that is provided in the main body frame to be capable of being pulled out, and includes a conveyance switching mechanism to eject the sheet on which the image is fixed by the fixing section to a specified sheet ejection section or to switch back the sheet without ejecting;

an intermediate unit that is, together with the fixing section, fixed and placed in the main body frame, and guides the sheet switched back by the relay unit toward a specified direction;

an automatic duplex unit that is mounted to the main body frame to be capable of being detached therefrom, and guides the switched back sheet guided by the intermediate unit to the image forming section, wherein a lower part of the automatic duplex unit is rotatably attached to the main body frame by a hinge mechanism, and an upper part of the automatic duplex unit can be attached to and detached from the main body frame by rotation thereof;

a guide member that is provided in the intermediate unit, is constructed to be capable of being opened and closed between a specified guide position at which the switched back sheet is guided to the automatic duplex unit and an open position opposite to the guide position, and receives a spring force toward the open position; and an opening and closing mechanism that is provided in the intermediate unit that moves the guide member to the guide position by contact with a pressing body of an automatic duplex unit side when the automatic duplex unit is mounted to the main body frame, and opens the guide member to the open position by the spring force when the automatic duplex unit is detached from the main body frame.

* * * * *